US006691650B2

(12) United States Patent
Zama et al.

(10) Patent No.: US 6,691,650 B2
(45) Date of Patent: Feb. 17, 2004

(54) PISTON VALVE TYPE LAYERED SCAVENGING 2-CYCLE ENGINE

(75) Inventors: Ryoji Zama, Higashimurayama (JP); Takeshi Watanabe, Nishitokyo (JP)

(73) Assignee: Komatsu Zenoah Co., Kawagoe (JP)

( * ) Notice: Subject to any disclaimer, the term of this patent is extended or adjusted under 35 U.S.C. 154(b) by 0 days.

(21) Appl. No.: 10/149,410

(22) PCT Filed: Dec. 13, 2000

(86) PCT No.: PCT/JP00/08788

§ 371 (c)(1),
(2), (4) Date: Nov. 6, 2002

(87) PCT Pub. No.: WO01/44634

PCT Pub. Date: Jun. 21, 2001

(65) Prior Publication Data

US 2003/0140874 A1 Jul. 31, 2003

(30) Foreign Application Priority Data

Dec. 15, 1999 (JP) ..... 11-355884
Jan. 14, 2000 (JP) ..... 2000-006859

(51) Int. Cl.[7] ..... F02B 33/04
(52) U.S. Cl. ..... 123/73 PP
(58) Field of Search ..... 123/73 PP

(56) References Cited

FOREIGN PATENT DOCUMENTS

| | | |
|---|---|---|
| JP | 51-160721 | 12/1976 |
| JP | 58-5423 | 1/1983 |
| JP | 58-146822 | 10/1983 |
| WO | WO98/57053 | 12/1998 |

*Primary Examiner*—Noah P. Kamen
(74) *Attorney, Agent, or Firm*—Armstrong, Kratz, Quintos, Hanson & Brooks, LLP

(57) ABSTRACT

A piston valve type layered scavenging 2-cycle engine has a reduced engine height, is light and compact, and achieves an exhaust gas purification. An upper edge of a pilot air port provided in an inner wall of a cylinder is positioned at substantially the same height as that of an upper edge of an intake port. An extended portion extended to a lower side rather than a piston lower edge at a position opposing to the intake port is provided in a lower end portion at a position opposing to the pilot air port in the piston. An interval between the right and left extended portions is set to be larger than an outer width of a balance weight of a crank shaft. A piston groove which connects the pilot air port to the scavenging port at a time of an intake stroke is provided on an outer peripheral surface of the extended portion. A second scavenging flow passage having a simple structure is provided in a lower side of a first scavenging flow passage.

4 Claims, 14 Drawing Sheets

PISTON VALVE TYPE LAYERED SCAVENGING 2-CYCLE ENGINE

TECHNICAL FIELD

The present invention relates to a piston valve type layered scavenging 2-cycle engine, and particularly to an improved arrangement of cylinder ports, piston shape and scavenging flow passage.

BACKGROUND ART

With respect to an arrangement of an intake port for an air-fuel mixture, a pilot air port and the like in a piston valve type layered scavenging 2-cycle engine (hereinafter, refer to as a layered scavenging 2-cycle engine), there is a structure disclosed in International Laid-Open No. WO98/57053 as one example. In accordance with this publication, a scavenging port 12, a pilot air port 14 and an exhaust port (not shown) are open to a cylinder chamber 11 (an inner peripheral surface of a cylinder 10) as shown in FIG. 13. The cylinder 10 is provided with an intake port 15, for an air-fuel mixture, which communicates with a crank chamber 3. A scavenging flow passage 16 connects between the cylinder chamber 11 and the crank chamber 3. Two pilot air ports 14 are provided in right and left sides with respect to the intake port 15. The pilot air ports 14 are provided at positions a predetermined distance apart from the scavenging port 12 to a side of the crank chamber 3 in an axial direction of the cylinder 10. The scavenging port 12 and the pilot air ports 14 are connected via a piston groove 34*a* provided in an outer peripheral portion of a piston 30*a,* whereby an air. Air is sucked into the scavenging flow passage 16 from the pilot air ports 14 via the scavenging port 12 at a time of an intake stroke. In order to prevent the pilot air ports 14 from being directly open to the cylinder chamber 11 during all the strokes of the piston 30*a,* a piston lower edge 31 is positioned below the pilot air ports 14 when at a top dead center of the piston shown by a solid line. A piston upper edge 35 is positioned above the pilot air ports 14 when at a bottom dead center of the piston shown by a narrow two-dot chain line. The piston lower edge 31 is positioned at a closest position to a crank shaft at which the piston lower edge does not interfere with an outer peripheral portion 23*a* of a balance weight 23 provided in the crank shaft, when at the bottom dead center of the piston. Since the intake port 15 is provided in parallel to a lateral direction to the pilot air ports 14, a vertical groove 40 having a predetermined length F is provided in the piston lower edge 31 portion, in order to communicate the intake port 15 with the crank chamber 3 when at the top dead center of the piston.

In accordance with the structure mentioned above, since an interior portion of the cylinder chamber 11 is at first scavenged by the pilot air at a time of being exhausted, it is possible to prevent an unburned gas from being discharged due to a blow-by of the air-fuel mixture, so that the exhaust gas can be cleaned up.

In the structure of the layered scavenging 2-cycle engine mentioned above, in order to communicate the suction port 15 with the crank chamber 3 at the top dead center of the piston, there is provided the vertical groove 40 having the length F extending from the piston lower edge 31 to the intake port upper edge 15*a.* Accordingly, the piston lower edge 31 is positioned the length F below the intake port upper edge 15*a.* At a time when the piston is at the bottom dead center, the piston upper edge 35 is positioned above the intake port upper edge 15*a,* and the piston lower edge 31 is defined so as to be positioned above the outer peripheral portion 23*a* of the balance weight in the crank shaft 20. At the top dead center of the piston, when setting a height from the intake port upper edge 15*a* to the piston upper edge 35 to H, it is necessary to set a piston height from the piston lower edge 31 to the piston upper edge 35 to +F.

There has been a requirement of making the height of the engine lower so as to make placing space as small as possible. There has been a strong desire to solve the problems that a length of a connecting rod is increased in correspondence to an increase of the piston height, therefore a height of the engine is increased, the placing space is increased, a weight thereof becomes heavy, and a cost is increased.

The layered scavenging 2-cycle engine has the scavenging flow passage which feeds the pilot air to the interior portion of the cylinder chamber so as to scavenge, in order to exhaust the gas within the cylinder after combustion to the external portion. FIG. 14 is a front elevational cross sectional view of a layered scavenging 2-cycle engine in accordance with a conventional second example, and FIG. 15 is a view along a line N—N in FIG. 14. A cylinder 82 is mounted to an upper surface of a crank case 81. A piston 83 is inserted to into a cylinder 82 so as to freely slide in an axial direction of the cylinder 82. A crank shaft 54 is rotatably mounted to the crank case 81. The piston 83 and the crank shaft 54 are connected by a connecting rod 55. An exhaust port 60 is open to a cylinder chamber 56, a pair of scavenging ports 61 and 61 and a pair of pilot air ports 62 and 62 are provided on a wall surface of the cylinder 82, and an air-fuel mixture port 63 open to a crank chamber 57 is provided thereon. A pair of scavenging flow passages 90 and 90 which respectively connect a pair of scavenging ports 51 and 51 to the crank chamber 57 are provided within a side wall of the cylinder 82. Opening portions 91 and 91 are respectively provided in lower end portions of the scavenging flow passages 90 and 90. A pair of grooves 84 and 84 for respectively connecting a pair of pilot air ports 62 and 62 to a pair of scavenging ports 61 and 61 near a top dead center of the piston are provided on a side surface of the piston 83. The exhaust port 60, the scavenging ports 61 and 61, the pilot air ports 62 and 62 and the air-fuel mixture port 63 are opened and closed on the basis of an upward and downward motion of the piston 83.

When the piston moves upward, a pressure of the crank chamber 57 is reduced, the pilot air is sucked from the pilot air ports 62 and 62 near the top dead center of the piston and is charged into the scavenging flow passages 90 and 90 from the scavenging ports 61 and 61 through the piston grooves 84 and 84. At the same time, the air-fuel mixture is sucked within the crank chamber 57 from the air-fuel mixture port 63. When the air-fuel mixture is ignited and burned in the cylinder chamber 56, the piston 83 is pressed down, and the pilot air ports 62 and 62 and the air-fuel mixture ports 63 are closed. Thereafter, the exhaust port 60 is at first opened, whereby the exhaust gas is discharged, and next the scavenging ports 61 and 61 are opened. The pressure in the crank chamber 57 is increased, the pilot air within the scavenging flow passages 90 and 90 flows into the cylinder chamber 56 so as to discharge the exhaust gas to an external portion from the exhaust port 60, and subsequently the air-fuel mixture within the crank chamber 57 flows into the cylinder chamber 56 from the scavenging ports 61 and 61 through the scavenging passages 90 and 90. An amount of blow-by of the air-fuel mixture from the exhaust port 60 to the external portion is reduced, and the exhaust gas is purified. However, since an amount of the pilot air is equal to a volume of the scavenging flow passage 90 and the amount is insufficient, the blow-by of a part of the air-fuel mixture is generated, so that it is impossible to sufficiently purify the exhaust gas.

In order to solve this, Japanese Unexamined Patent Publication No. 58-5423 is proposed as a conventional third example. FIG. 16 is a front elevational cross sectional view of a layered scavenging 2-cycle engine described in the publication. A cylinder 82 is mounted to an upper surface of a crank case 85. A scavenging port 61 communicates with a crank chamber 57 via a scavenging flow passage 92. The scavenging flow passage 92 passes through an interior portion of a side wall the cylinder 82 and passes through an interior portion of d side wall of the crank case 85 so as to communicate with an opening portion 93 provided in a bottom portion of the crank chamber 57. That is, since the scavenging flow passage 92 is long and large, an amount of pilot air can be sufficiently secured, a blow-by of an air-fuel mixture is greatly reduced, and an exhaust gas is purified.

However, since the scavenging flow passage 92 is formed within the side wall of the crank case 85, there are problems that a structure of the crank case 85 becomes complex, enlarged and heavy, and a cost is increased.

DISCLOSURE OF THE INVENTION

An object of the present invention is to provide a layered scavenging 2-cycle engine which can reduce a length of a piston in a direction of a cylinder shaft so as to reduce a height of an engine, thereby making a placing space small and reducing a weight. Another object is to provide an engine which can sufficiently secure an amount of pilot air so as to provide exhaust gas purification.

In accordance with a first aspect of the present invention, there is provided a piston valve type layered scavenging 2-cycle engine having: 1) a scavenging port, an exhaust gas port and a pilot air port which are open to an inner wall of a cylinder attached to an upper portion of a crank case connected to a cylinder chamber; 2) an intake port for an air-fuel mixture which is open to the inner wall of the cylinder and is in communication with a crank chamber; 3) a scavenging flow passage which connects the scavenging port and the crank chamber; and 4) a piston groove which is provided in an outer peripheral portion of the piston and connects the scavenging port and the pilot air port at a time of an intake stroke. The scavenging port, the exhaust port, the pilot air port and the intake port are opened and closed by an upward and downward motion of the piston.

A lower edge of the pilot air port is arranged at a position close to the crank chamber side rather than an upper edge of the intake port. An extended portion extended to a lower side, rather than a piston lower edge, at a position opposing to the intake port of the piston is provided in a lower portion at a position opposing to the pilot air port of the piston. The extended portion is positioned at an outer side in a direction of a crank shaft, rather than a balance weight attached to a web of the crank shaft, and has the piston groove on an outer peripheral surface thereof.

Since the lower edge of the pilot air port is arranged at the position close to the crank chamber side rather than the upper edge of the intake port, it is possible to dispose the upper edge of the pilot air port close to the crank chamber side. Accordingly, it is possible to dispose the position of the piston upper edge, when at a time of a bottom dead center of the piston, close to the crank chamber side. The piston lower edge portion in an outer side in an axial direction from the balance weight of the crank shaft is extended, and the piston groove connecting the pilot air port and the scavenging port is provided in this portion. Accordingly, it is possible to move the piston lower edge down to a position at which the piston lower edge does not interfere with the outer peripheral portion of the balance weight at a time of the bottom dead center of the piston. Accordingly, it is possible to reduce a piston height from the piston upper edge to the piston lower edge, and it is possible to obtain the layered scavenging 2-cycle engine which is low in an engine height, light and compact, and has a reduced cost.

In accordance with a second aspect of the present invention, there is provided a piston valve type layered scavenging 2-cycle engine, as recited in the first aspect, wherein the upper edge of the intake port and the upper edge of the pilot air port are positioned at substantially the same height.

It is possible to dispose the piston upper edge, at a time of the bottom dead center of the piston, to the crank chamber side up to the portion close to the intake port upper edge, and it is possible to further reduce the length of the piston in the direction of the cylinder shaft. Since it is possible to reduce the length of the connecting rod so as to reduce the engine height, it is possible to further reduce the weight, and the cost can be reduced.

In accordance with a third aspect of the present invention, there is provided a piston valve type layered scavenging 2-cycle engine having a scavenging port which is open to a cylinder chamber of a cylinder mounted on an upper surface of a crank case forming a crank chamber in an inner side thereof, and sucking a pilot air taken from an external portion so as to scavenge. A scavenging flow passage is provided in an outer side rather than a side wall surface of the cylinder chamber, and communicates the scavenging port and the crank chamber. The scavenging flow passage has a first scavenging passage which is provided in an outer side of a side wall surface of the cylinder so as to be substantially in parallel to an axis of the cylinder, and a second scavenging flow passage which is provided on an upper surface of the crank case opposing to the first scavenging passage so as to be expanded in a substantially perpendicular direction to the first scavenging passage. The second scavenging flow passage has an opening portion communicating with the crank chamber in a terminal portion. The opening portion and the second scavenging passage are formed by: 1) a recess portion which is provided on the upper surface of the crank case; 2) a cylinder base surface of the cylinder which is brought into contact with the upper surface of the crank case; 3) a cylinder skirt portion in a lower portion of a side surface of the cylinder; and 4) a cylinder skirt extended portion which is extended so as to make a portion opposing to the second scavenging passage in the cylinder skirt portion close to or in contact with a bottom surface portion of the recess portion.

Since the second scavenging flow passage which is provided with the recess portion on the upper surface of the crank case is provided in the lower side of the first scavenging flow passage which is provided in the outer side of the cylinder wall surface and communicates with the scavenging port, and the opening portion is provided in the terminal portion of the second scavenging flow passage, it is possible to secure a large capacity for the scavenging flow passage. Accordingly, it is possible to secure enough pilot air to scavenge, and it is possible to securely achieve an exhaust gas purification. Since the second scavenging flow passage and the opening portion thereof are formed by the recess portion which is provided on the upper surface of the crank case, the cylinder base surface, the cylinder skirt portion and the cylinder skirt extended portion, the structure can be made simple, the crank case can be made compact and light, and it is possible to obtain an inexpensive layered scavenging 2-cycle engine.

In accordance with a fourth aspect of the present invention, there is provided a piston valve type layered scavenging 2-cycle engine as recited in the first aspect, wherein the scavenging flow passage has a first scavenging passage which is provided in an outer side of a side wall surface of the cylinder so as to be substantially in parallel to an axis of the cylinder, and a second scavenging flow passage which is provided on an upper surface of the crank case opposing to the first scavenging passage so as to be expanded in a substantially perpendicular direction to the first scavenging passage. The second scavenging flow passage has an opening portion communicating with the crank chamber in a terminal portion. The opening portion and the second scavenging passage are formed by: 1) a recess portion which is provided on an upper surface of the crank case; 2) a cylinder base surface of the cylinder which is brought into contact with the upper surface of the crank case; 3) a cylinder skirt portion in a lower portion of a side surface of the cylinder; and 4) a cylinder skirt extended portion which is extended so as to make a portion opposing to the second scavenging passage in the cylinder skirt portion close to or in contact with a bottom surface portion of the recess portion.

It is possible to obtain a layered scavenging 2-cycle engine which becomes lighter and more compact, has a reduced cost and can securely achieve an exhaust gas purification.

BEST MODE FOR CARRYING OUT THE INVENTION

Figure 1:
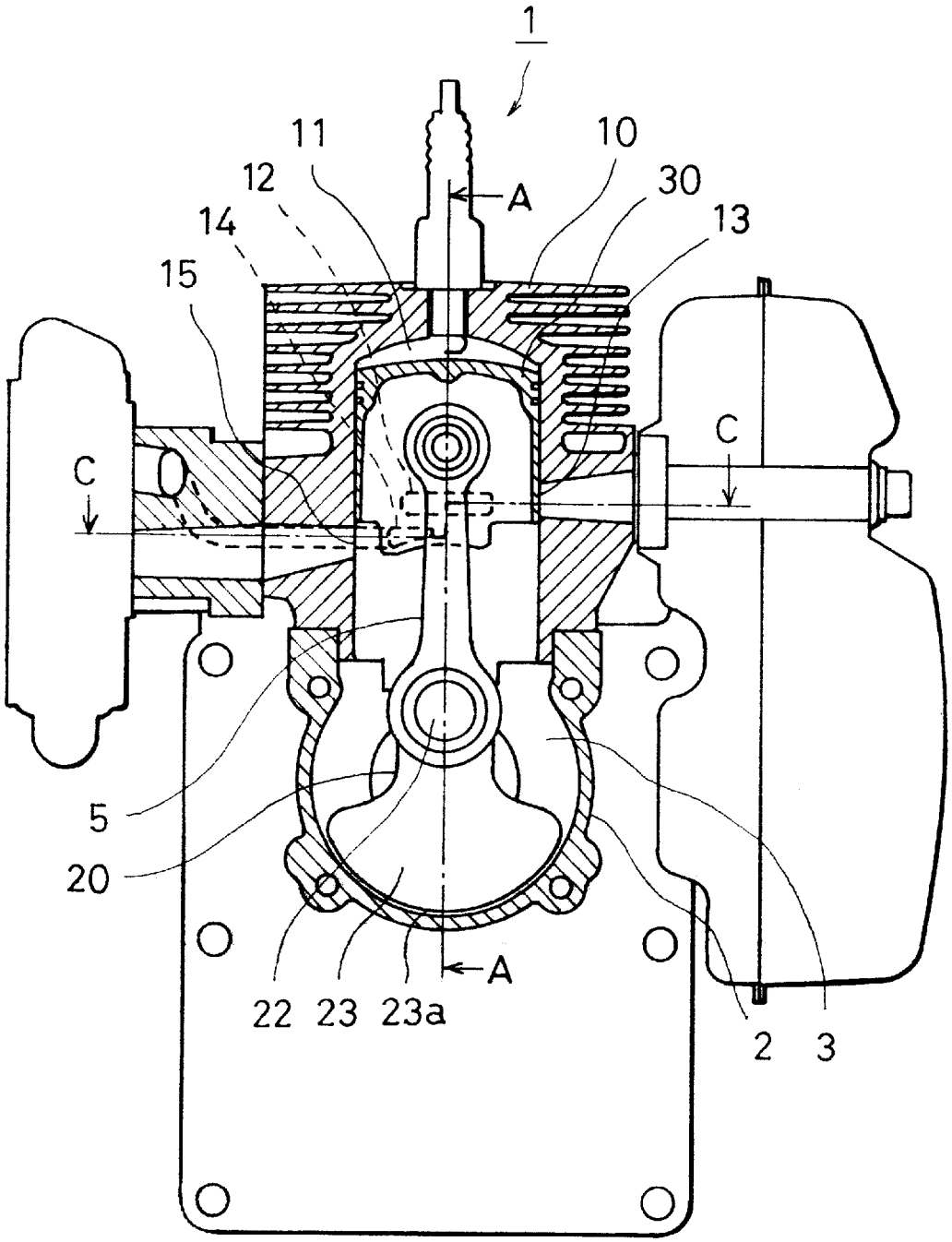
FIG. 1 is a front elevational cross sectional view of a layered scavenging 2-cycle engine in accordance with a first embodiment of the present invention at a time of a top dead center of a piston.
Figure 2:
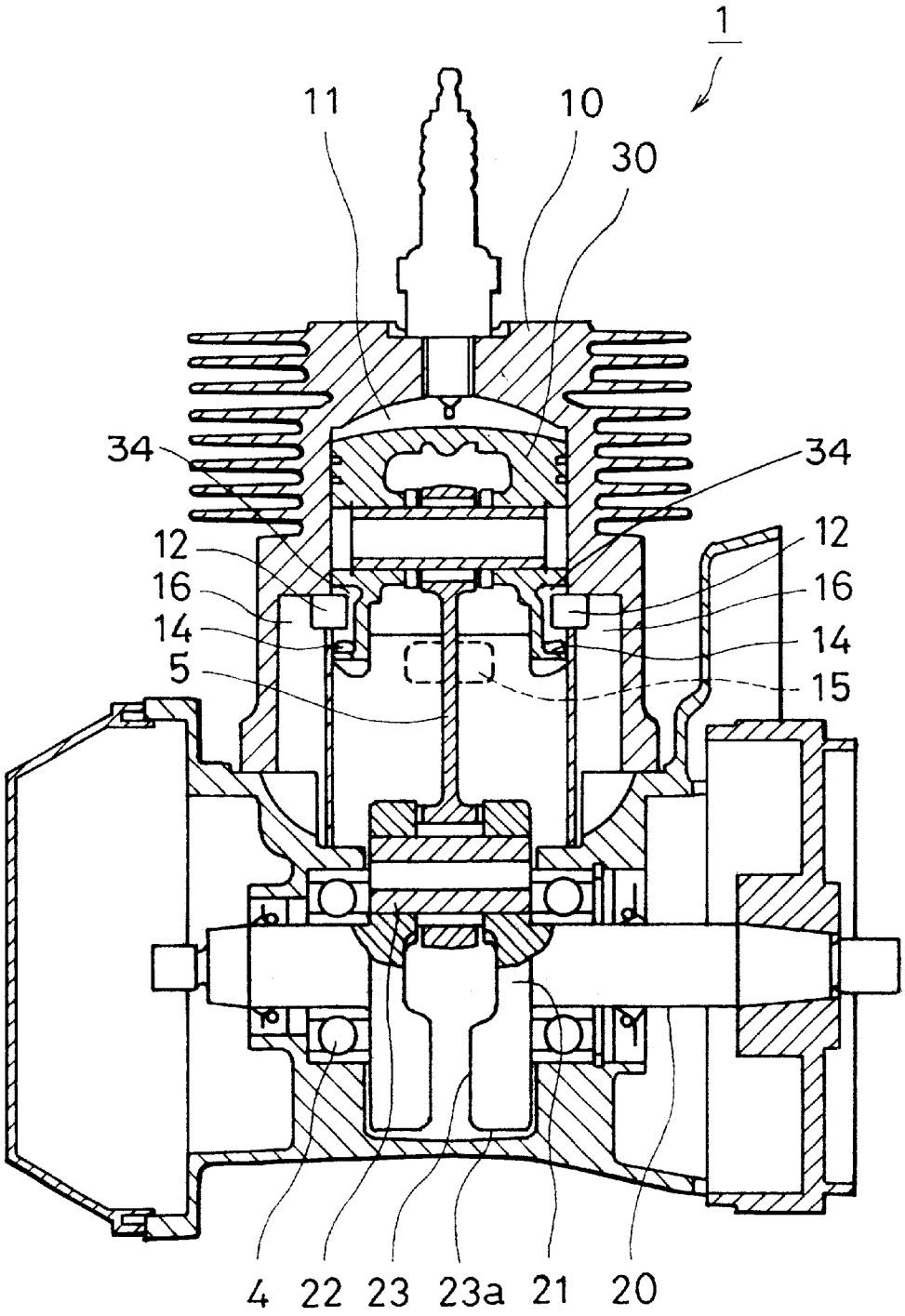
FIG. 2 is a side elevational cross sectional view at a time of a top dead center of the piston in FIG. 1.

FIG. 1 is a front elevational cross sectional view of a layered scavenging 2-cycle engine in accordance with a first embodiment, and FIG. 2 is a side elevational cross sectional view thereof and shows a state in which a piston is at a top dead center position. A cylinder 10 is attached to an upper portion of a crank case 2. A piston 30 is inserted into the cylinder 10 so as to freely slide in an axial direction of the cylinder 10. A cylinder chamber 11 is formed in a head side of the piston 30, and a crank chamber 3 is formed in a bottom side. A crank shaft 20 is rotatably attached to the crank case 2 via a bearing 4, and the piston 30 is connected by a connecting rod 5. A balance weight 23 is provided at a position opposite to the crank pin 22, in a web 21 of the crank shaft 20, and an outer peripheral portion 23*a* thereof is formed in a circular arc shape. A scavenging port 12 connected to the cylinder chamber 11, an exhaust port 13 and a pilot air port 14 are provided on an inner wall surface of the cylinder 10. An intake port 15 for an air-fuel mixture is connected to the crank chamber 3. A scavenging flow passage 16 connects the scavenging port 12 to the crank chamber 3 in the cylinder 10.

Figure 3:
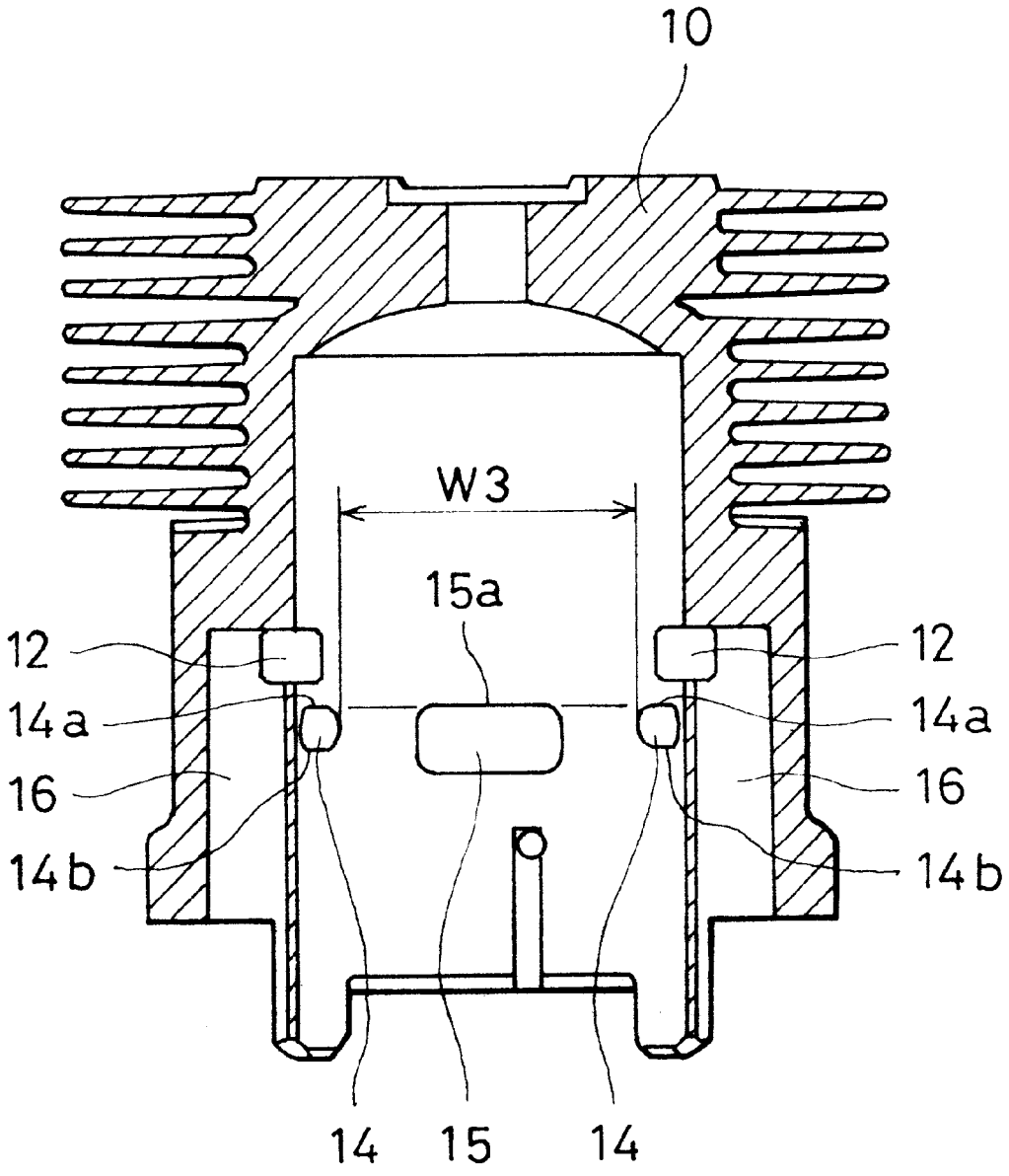
FIG. 3 is a cross sectional view of a cylinder along a line A—A in FIG. 1.

FIG. 3 is a cross sectional view of the cylinder 10 along a line A—A in FIG. 1. Two pilot air ports 14 and 14 are provided in both sides of the intake port 15. Each of pilot air port lower edges 14*b* and 14*b* is positioned in a lower side of an intake port upper edge 15*a*. The intake port upper edge 15*a* and pilot air port upper edges 14*a* and 14*a* are positioned at the same height. The scavenging ports 12 and 12 are provided in an upper side of the pilot air ports 14 and 14 at a predetermined interval, and are respectively connected to scavenging flow passages 16 and 16.

Figure 4:
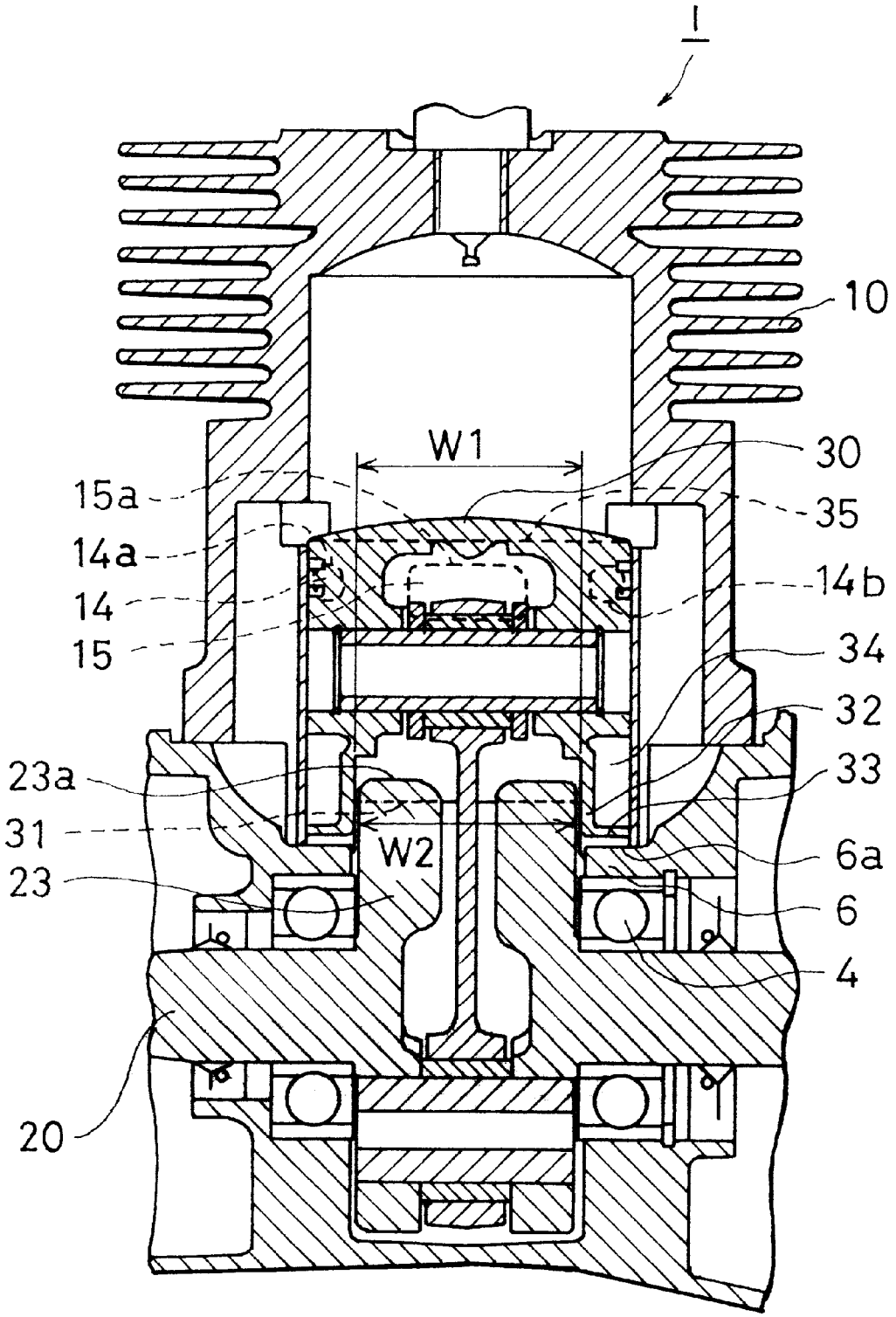
FIG. 4 is a side elevational cross sectional view at a time of a bottom dead center of the piston in FIG. 1.

FIG. 4 is a side elevational cross sectional view of the layered scavenging 2-cycle engine at a piston bottom dead center position. A piston lower edge 31 is set to a position closest to the crank shaft 20 at which the piston lower edge does not interfere with outer peripheral portions 23*a* and 23*a* of both balance weights 23 and 23 in the crank shaft 20. This portion corresponds to a position opposing to the intake port 15 at a time when the piston 30 moves upward and downward. Extended portions 32 and 32 are provided in both lower end portions of the piston 30 in an axial direction of the crank shaft 20 so as to be extended to a lower side from the piston lower edge 31. A piston groove 34 is provided in an outer periphery of the extended portion 32, respectively. An inner width W1 of the extended portion 32 is set to be larger than an outer width W2 between both of the balance weights 23 and 23 in the direction of the crank shaft. An interval W3 between two pilot air ports 14 and 14, shown in FIG. 3, is set to be larger than the inner width W1 of the extended portion 32. An extended portion lower edge 33 is set at a position at which the extended portion lower edge does not interfere with an outer peripheral portion 6*a* of a boss 6 in which the bearing 4 provided in the crank chamber 3 is internally provided. The extended portion 32 is provided at a position opposing to the pilot air port 14 at a time when the piston 30 moves upward and downward. A piston groove 34 provided in the extended portion 32 connects the scavenging port 12 to the pilot air port 14 at the piston top dead center position, as shown in FIG. 2. A piston upper edge 35 is set so as to be positioned at an upper side, rather than the intake port upper edge 15*a*, and the pilot air port upper edge 14*a* at the piston bottom dead center position as shown in FIG. 4.

Figure 5:
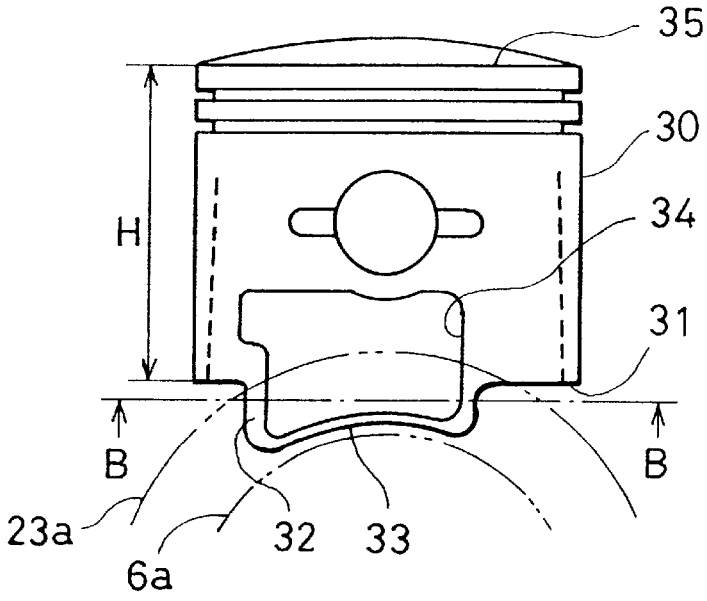
FIG. 5 is a front elevational view of the piston in accordance with the first embodiment.
Figure 6:
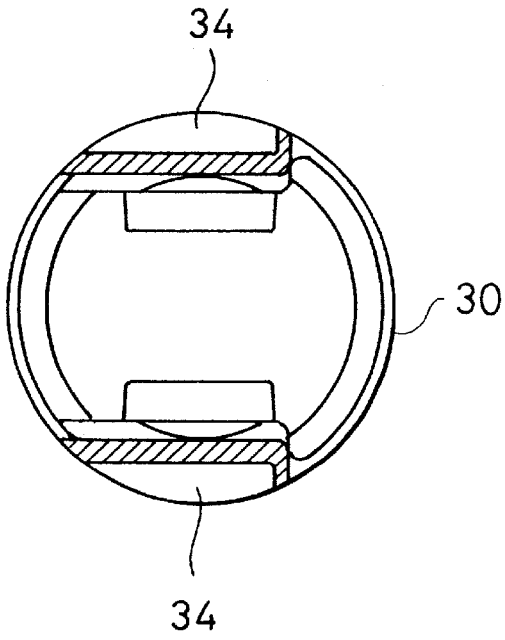
FIG. 6 is a view along a line B—B in FIG. 5.

FIG. 5 is a front elevational view of the piston 30, and FIG. 6 is a view along a line B—B in FIG. 5. The extended portion 32 is provided in the lower end portion of the piston 30 so as to be extended to the lower side rather than to the piston lower edge 31. The piston groove 34 is provided on an outer peripheral surface of the extended portion 32. The piston lower edge 31 is set to a position at which the piston lower edge does not interfere with the balance weight outer peripheral portion 23*a*. The extended portion lower edge 33 is set to a position at which the extended portion lower edge does not interfere with the outer peripheral portion 6*a* of the boss 6 in the crank chamber 3, respectively. A piston height from the piston upper edge 35 to the piston lower edge 31 is H.

Figure 7:
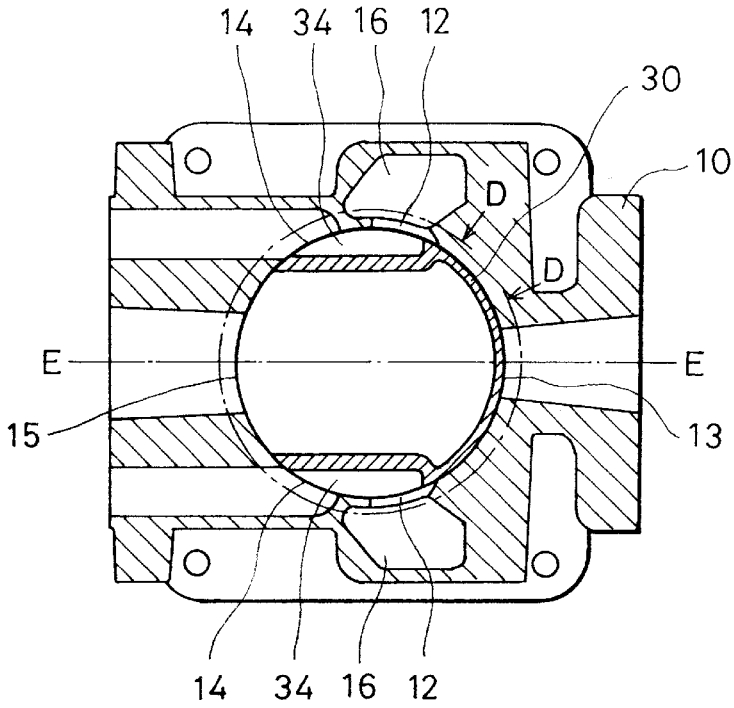
FIG. 7 is a view along a line C—C in FIG. 1.

FIG. 7 is a view along a line C—C in FIG. 1. The exhaust port 13 is provided in an opposite side of the intake port 15, and the pilot air ports 14 and 14 are provided in both sides of the intake port 15. The scavenging ports 12 and 12, and the scavenging flow passages 16 and 16 are provided in both sides in a perpendicular direction to a center line E—E connecting the intake port 15 to the exhaust port 13. At the piston top dead center position, two piston grooves 34 and 34 respectively connect the pilot air ports 14 and 14 to the scavenging ports 16 and 16.

Figure 8:
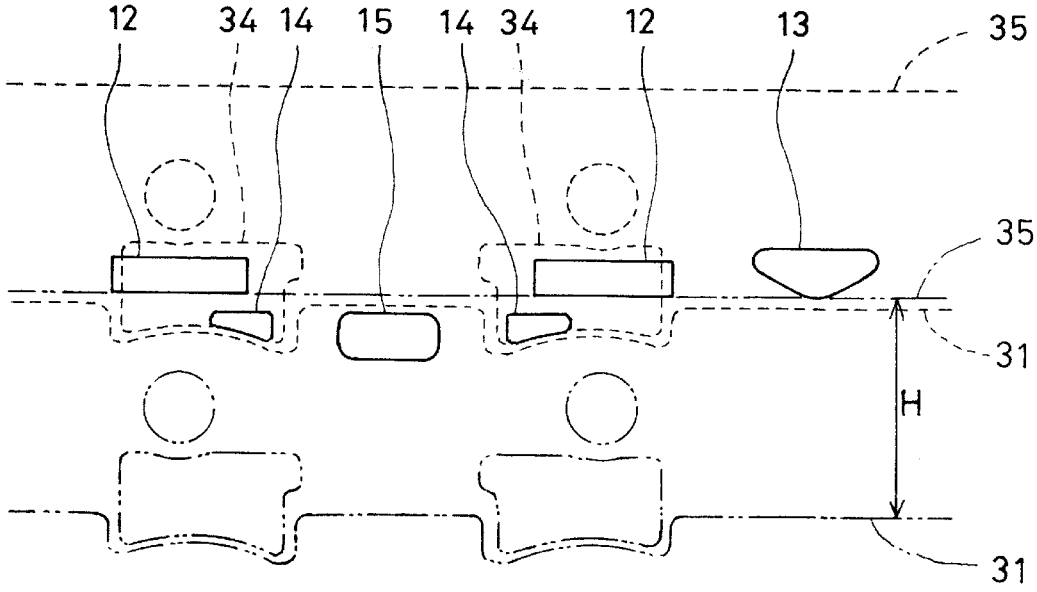
FIG. 8 is an expansion view along a line D—D in FIG. 7.

FIG. 8 is an expansion view along a line D—D in FIG. 7, and shows a relational position between the respective ports provided on the cylinder inner wall surface and the piston. Solid lines show the scavenging ports 12 and 12, the exhaust port 13, the pilot air ports 14 and 14, and the intake port 15 which are provided on the inner wall surface of the cylinder 10. Narrow broken lines show the piston upper edge 35, the piston lower edge 31 and the piston groove 34 at the top dead center position. Narrow two-dot chain lines show the piston upper edge 35 and the piston lower edge 31 at the bottom dead center, respectively. At the piston top dead center position, the piston groove 34 connects the pilot air port 14 to the scavenging port 12. The piston lower edge 31 is positioned in the upper side of the intake port 15. At the piston bottom dead center, the piston upper edge 35 is positioned in the lower side of the scavenging port 12 and the exhaust port 13, and is positioned in the upper side of the pilot air port 14 and the intake port 15. A distance from the piston upper edge 35 to the piston lower edge 31 is the piston height H shown in FIG. 5.

Figure 13:
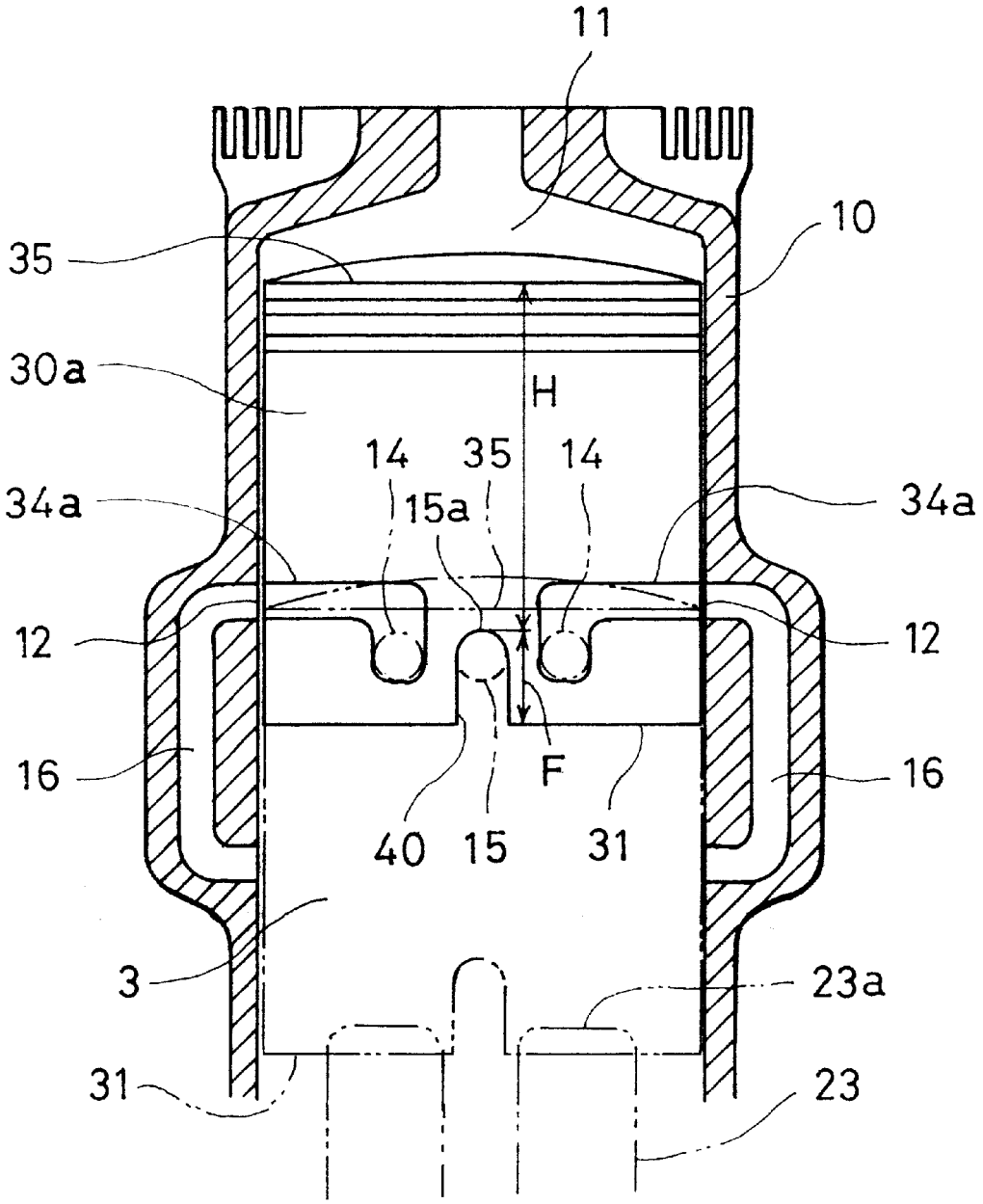
FIG. 13 PRIOR ART
FIG. 13 is a side elevational cross sectional view of a cylinder portion in a layered scavenging 2-cycle engine in accordance with a first example of the prior art.
Figure 14:
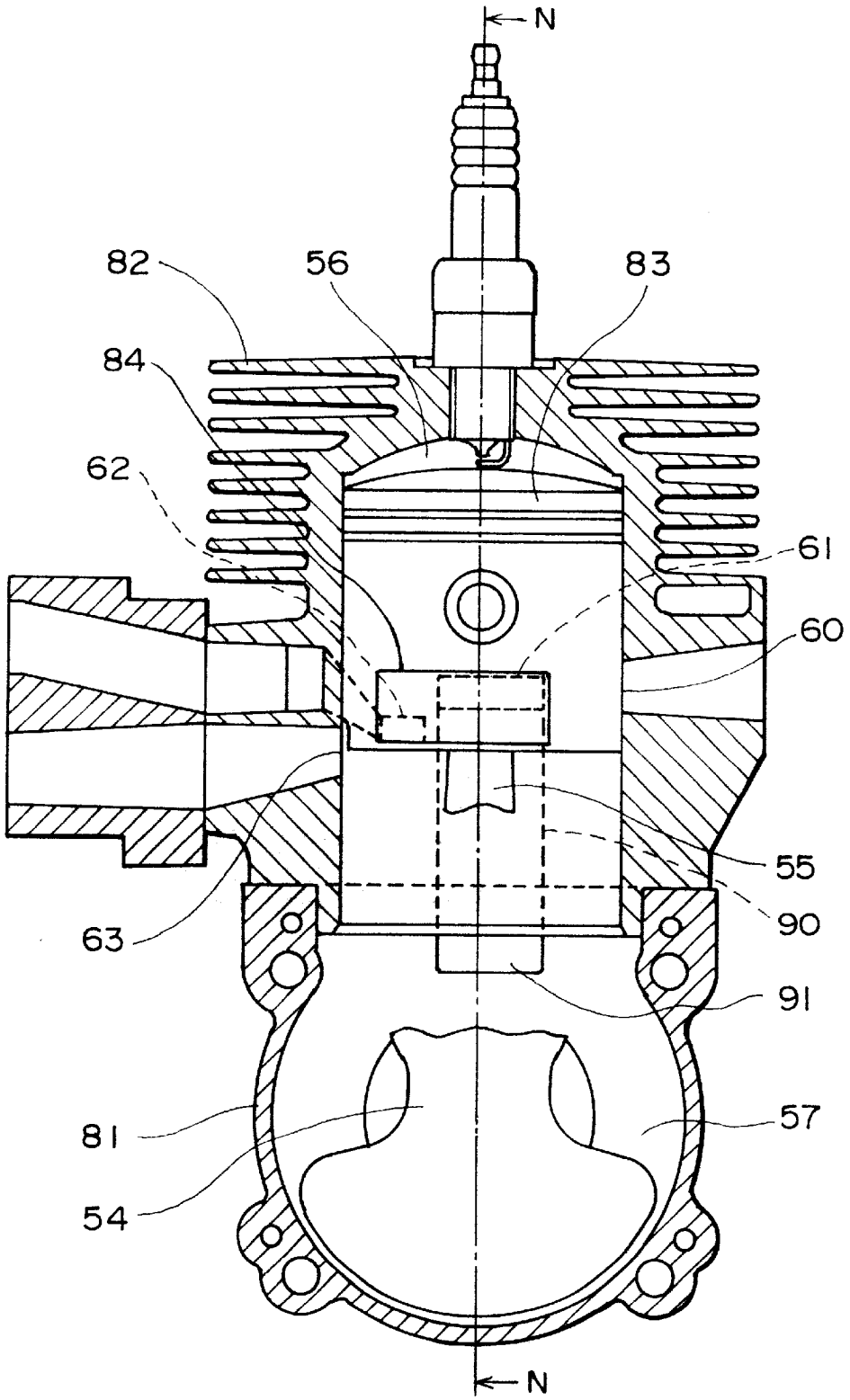
FIG. 14 PRIOR ART
FIG. 14 is a front elevational cross sectional view of a layered scavenging 2-cycle engine in accordance with a second example of the prior art.
Figure 15:
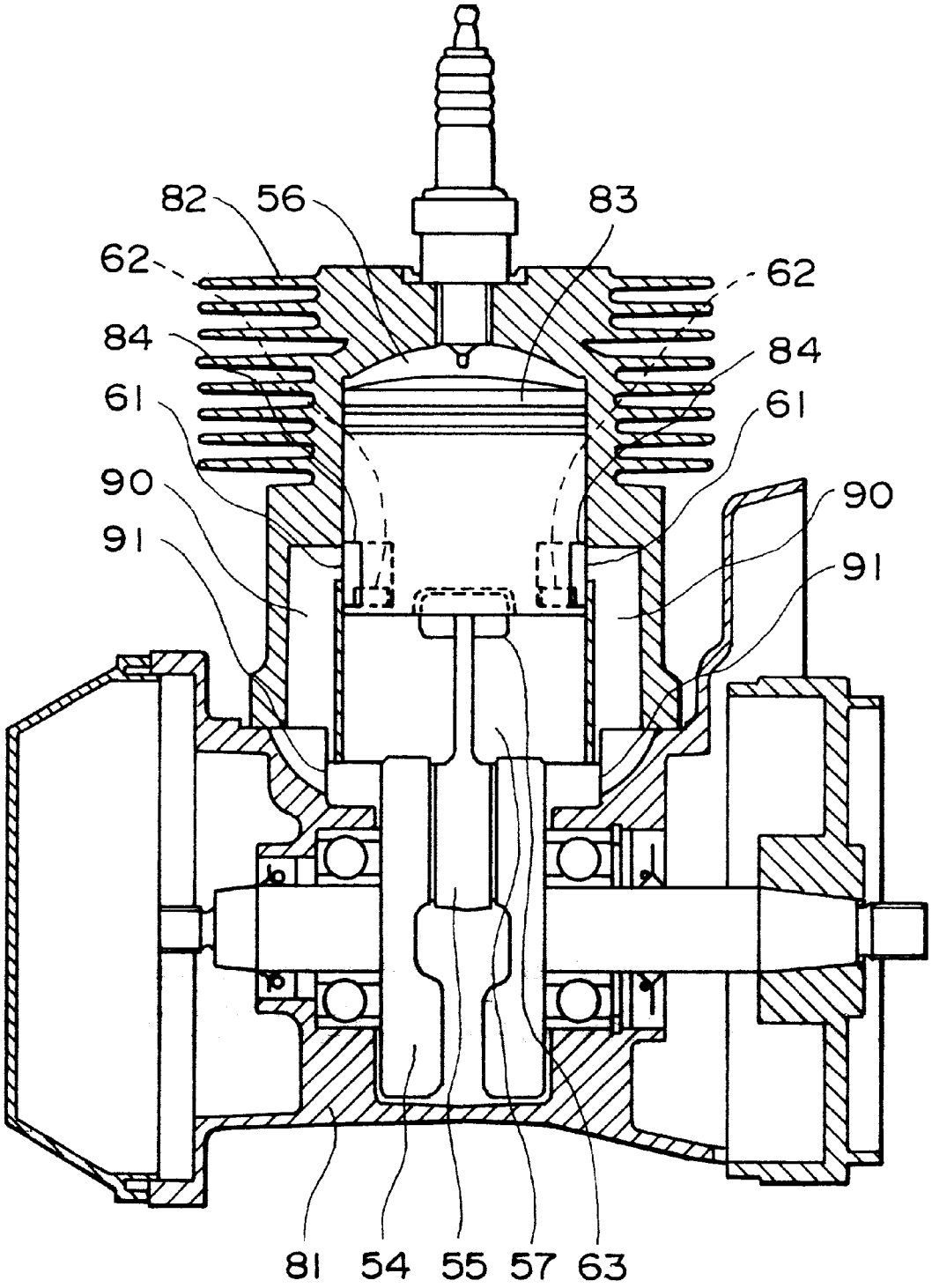
FIG. 15 PRIOR ART
FIG. 15 is a view along a line N—N in FIG. 14.
Figure 16:
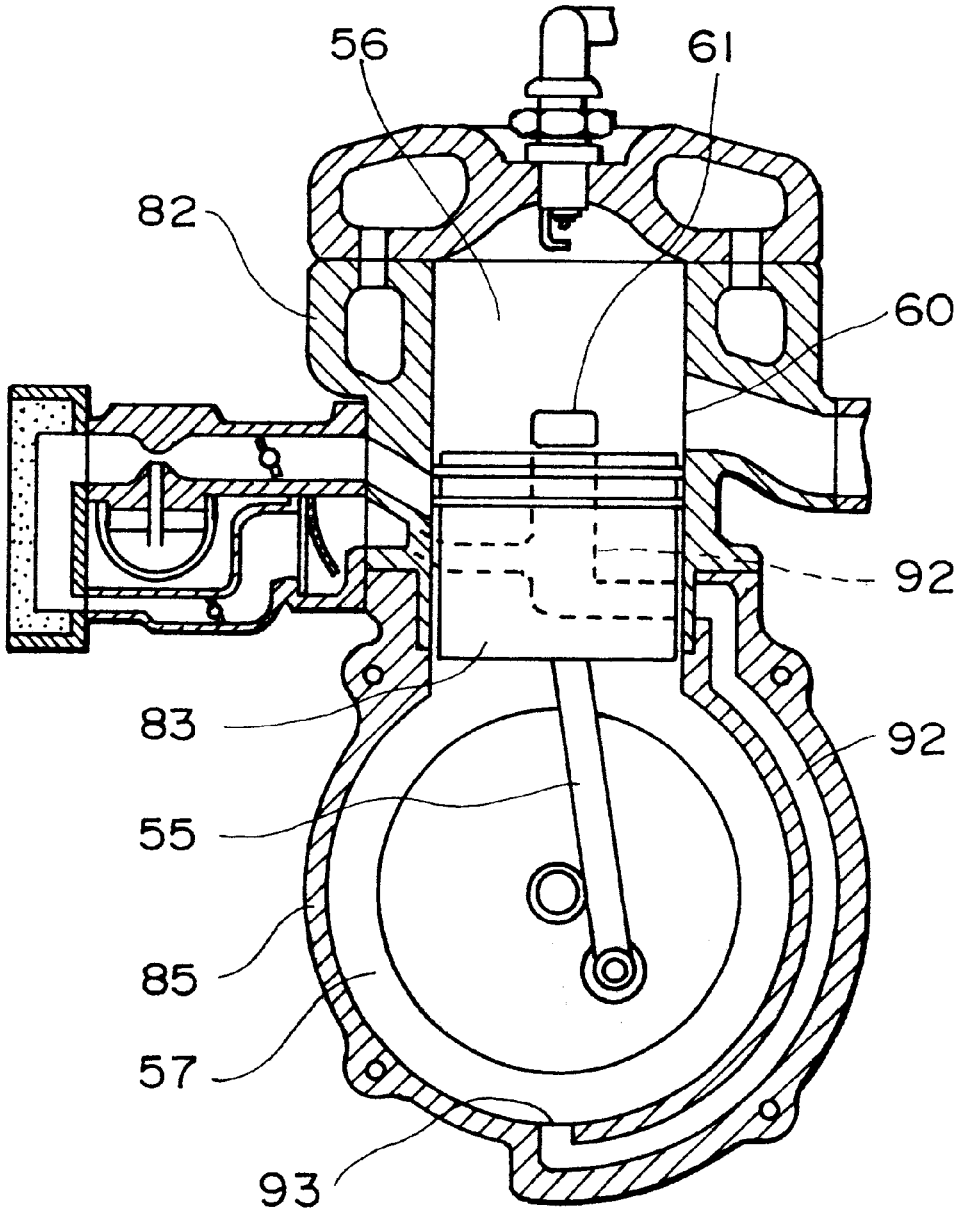
FIG. 16 PRIOR ART
FIG. 16 is a front elevational cross sectional view of a layered scavenging 2-cycle engine in accordance with a third example of the prior art.

Since the layered scavenging 2-cycle engine 1 in accordance with the first embodiment is structured in the manner mentioned above, it is possible to make a height of the piston 30 low. That is, in comparison with the conventional piston 30*a* shown in FIG. 13, it is possible to shift the positions of the intake port 15 and the pilot air port 14 to be close to the crank chamber 3 at a length F, and it is possible to shift the position of the piston upper edge 35 close to the crank chamber 3 at the length F. Accordingly, although the height of the conventional piston is +F the height of the piston in accordance with the present embodiment is H and can be made lower at. The height is reduced by the length F. Since it is possible to make the connecting rod 5 short shorter accordingly, it is possible to obtain the layered scavenging 2-cycle engine which has a reduced height, is light and compact and has a reduced cost.

Figure 9:
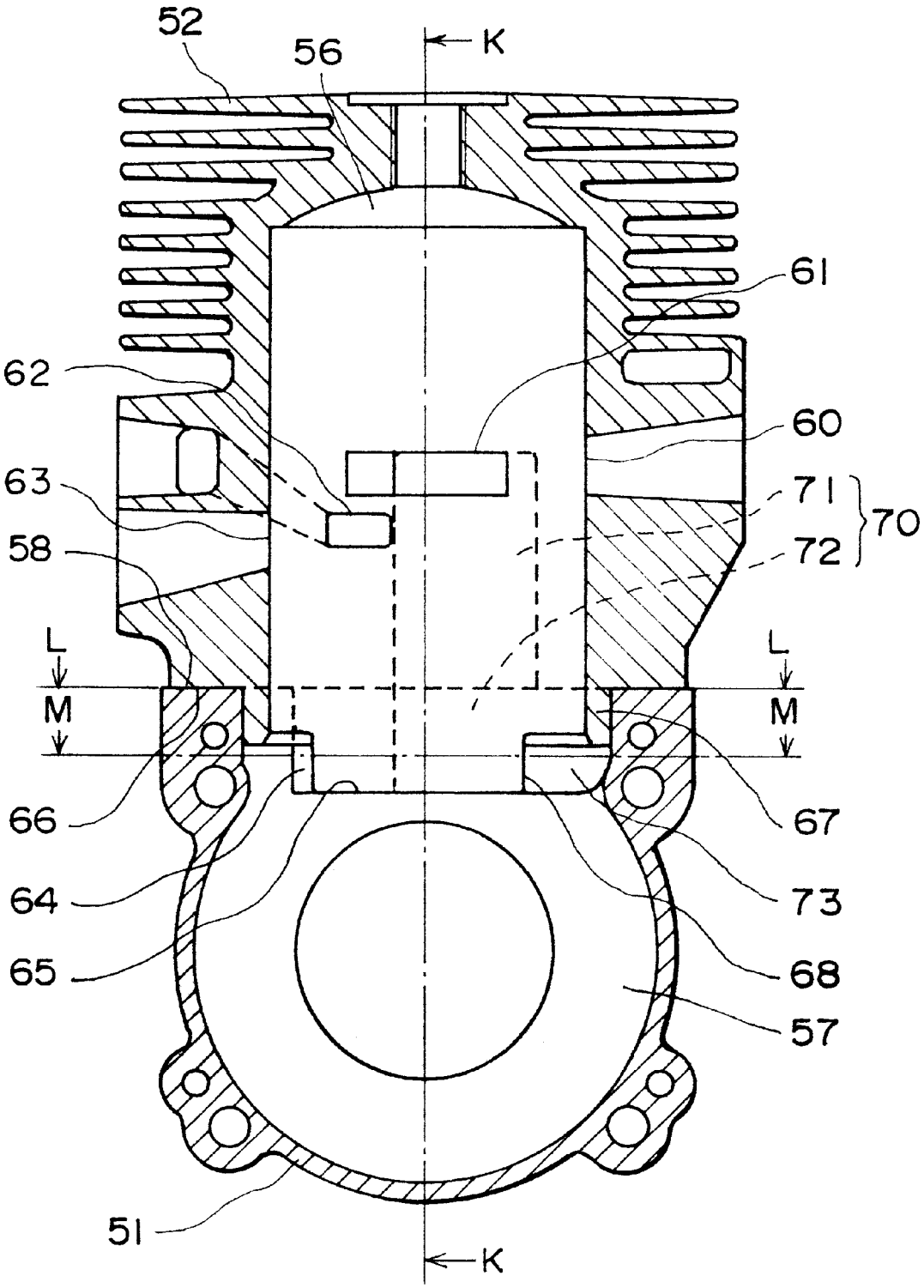
FIG. 9 is a front elevational cross sectional view of a cylinder and a crank case in accordance with a second embodiment of the present invention.
Figure 10:
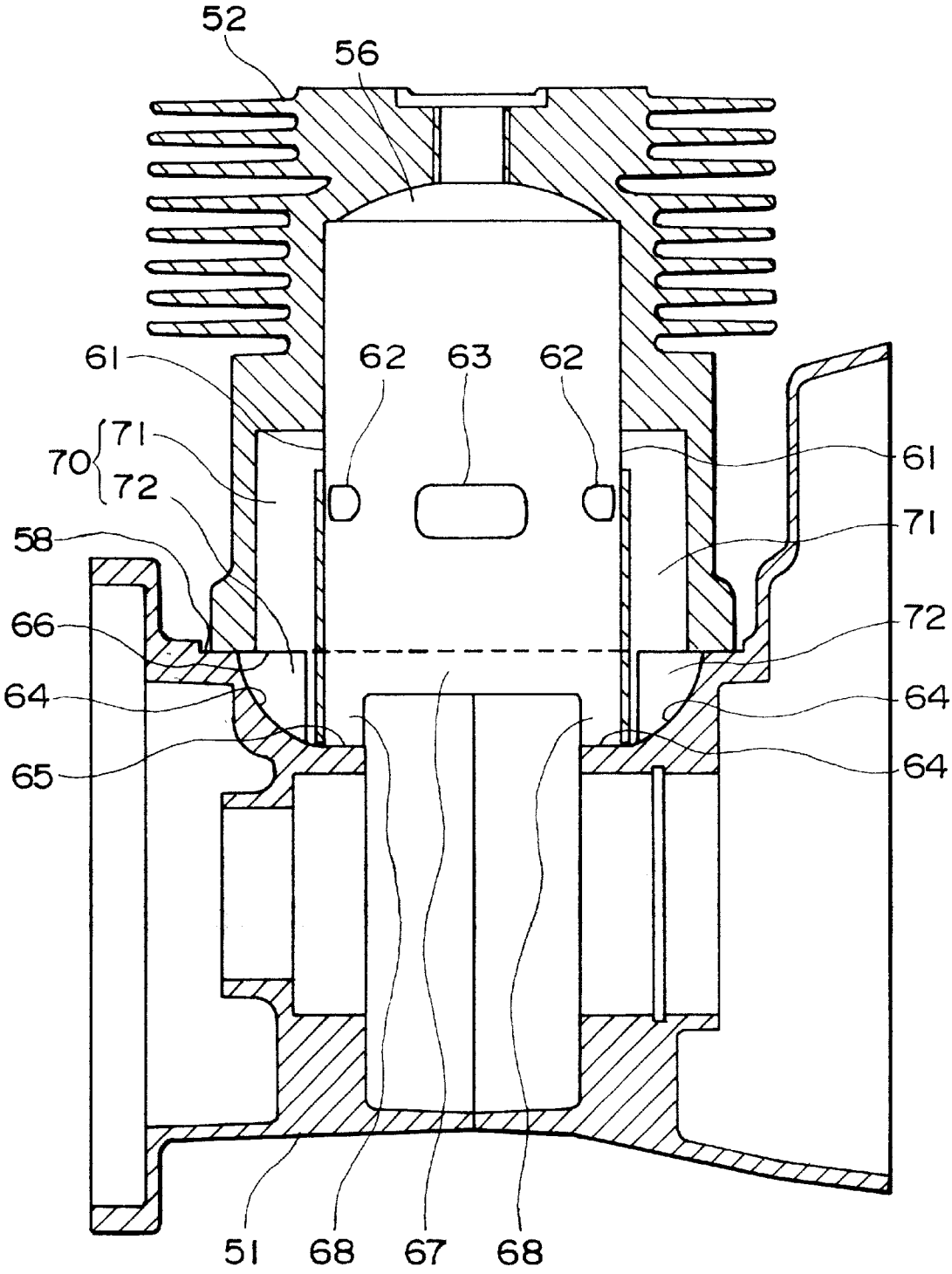
FIG. 10 is a view along a line K—K in FIG. 9.

FIG. 9 is a front elevational cross sectional view of a cylinder and a crank case in accordance with the second embodiment, and FIG. 10 is a view along a line A—A in FIG. 9. A cylinder 52 is mounted on an upper surface 58 of a crank case 51 so as to bring a cylinder base surface 66 into contact with the crank case, and is fastened by bolts (not shown). An exhaust port 60, a pair of scavenging ports 61 and 61, a pair of pilot air ports 62 and 62 and an air-fuel mixture port 63 are open to an inner wall of the cylinder 52. A pair of first scavenging flow passages 71 and 71 which communicate with the scavenging ports 61 and 61 in upper portions, have open portions in lower portions thereof, and are in parallel to a cylinder axis are provided within a side wall of the cylinder 2. A pair of recess portions 74 and 74 which communicate respectively with the lower opening portions of a pair of first scavenging flow passages 71 and 71 and are expanded in a substantially perpendicular direction with respect to the first scavenging flow passages 71 and 71 are provided in the upper surface 58 of the crank case 51. A pair of second scavenging flow passages 72 and 72, which have an opening portion 73 communicating with the crank chamber 57, are provided in terminal portions of the respective recess portions 74 and 74. The scavenging flow passage 70 is constituted by the first and second scavenging flow passages 71 and 72.

Figure 11:
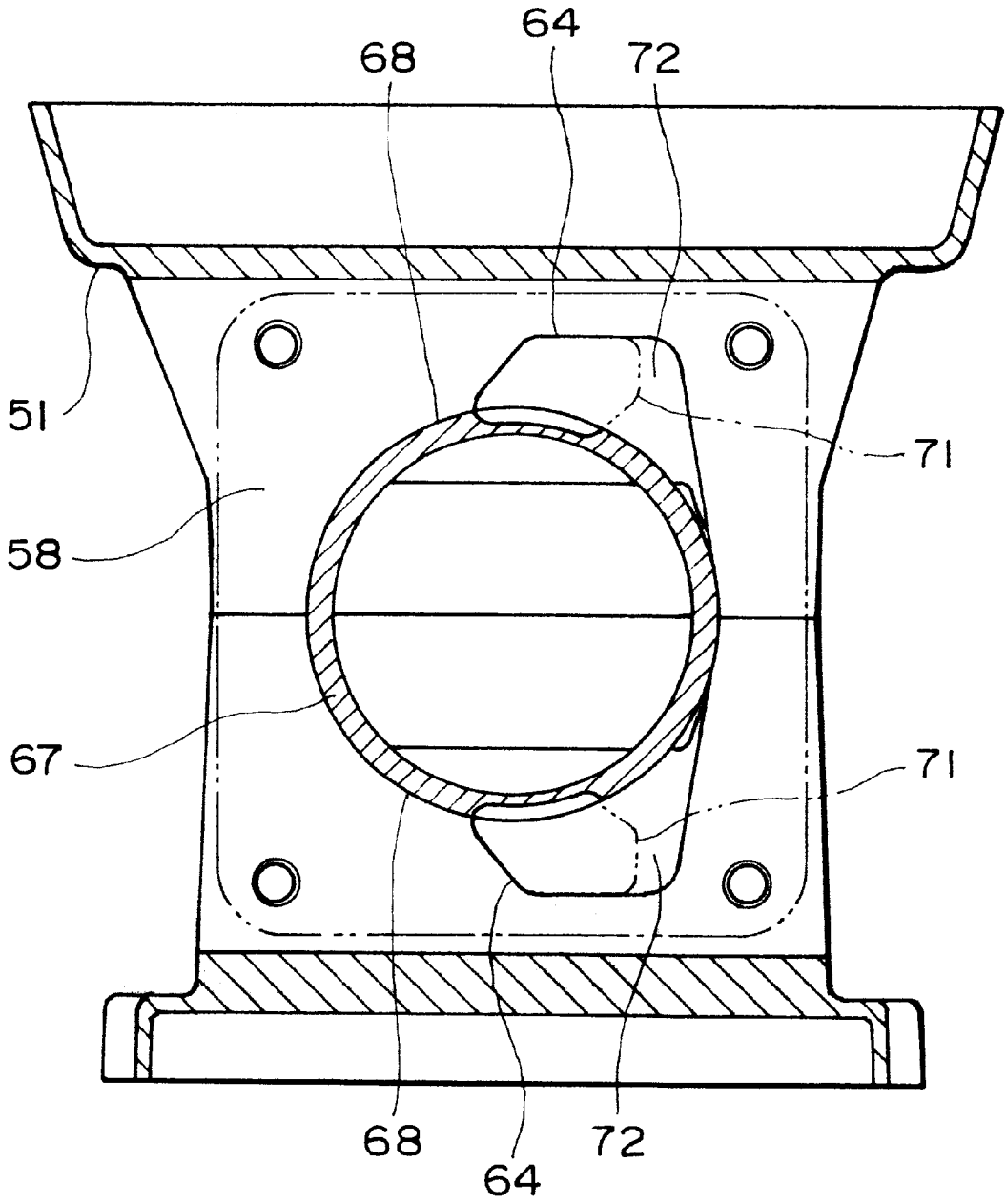
FIG. 11 is a view along a line L—L in FIG. 9.
Figure 12:
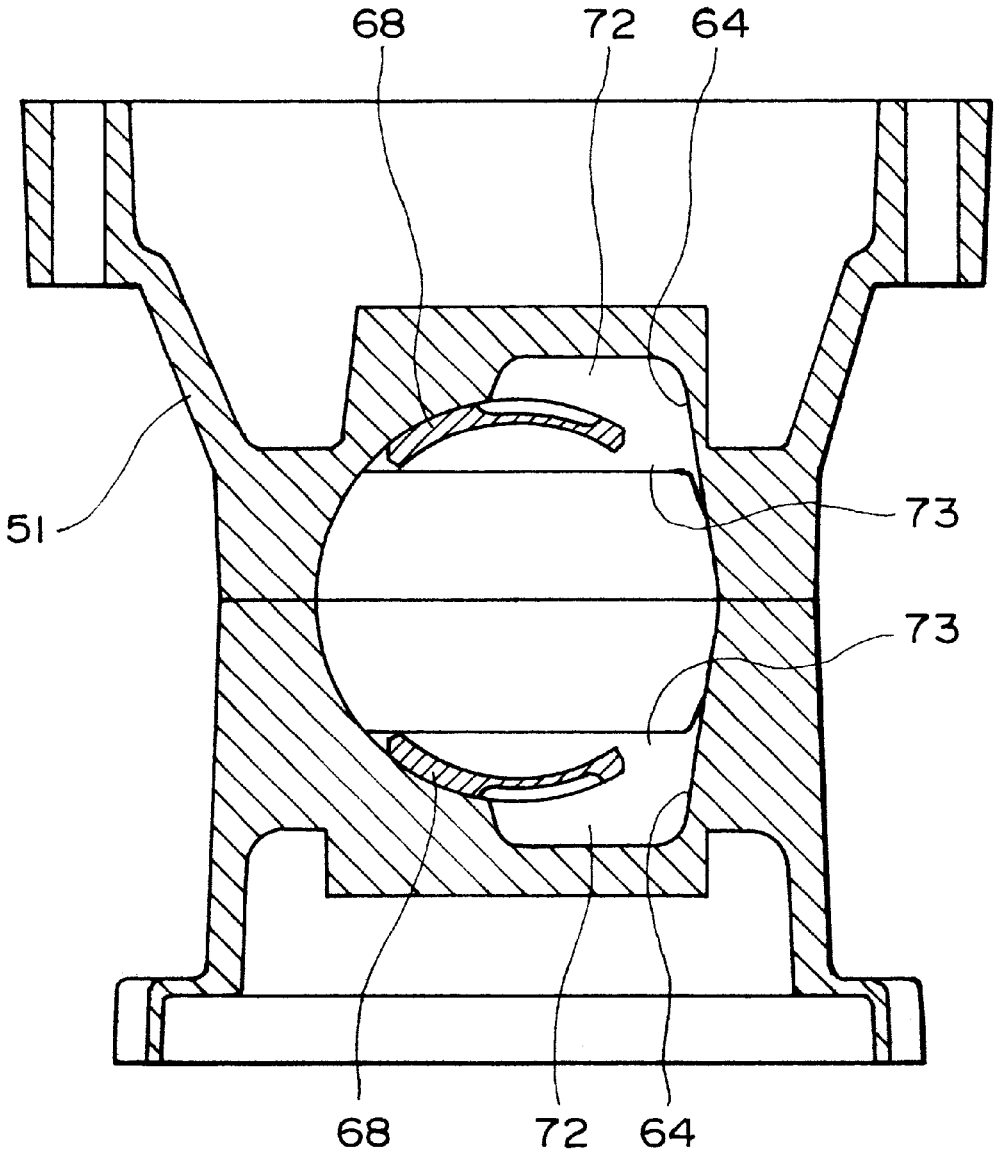
FIG. 12 is a view along a line M—M in FIG. 9.

FIG. 11 is a view along a line L—L in FIG. 9, and shows a shape of a recess portion 64 formed on the crank case upper surface 58. A cylinder skirt extended portion 68 is provided in a portion corresponding to the second scavenging flow passage 72 in a skirt portion 67 of the cylinder 52, and a front end portion thereof is close to or brought into contact with a bottom surface of the recess portion 64. That is, the second scavenging flow passage 72 is formed by the recess portion 64, the cylinder base surface 66, the cylinder skirt portion 67, and the cylinder skirt extended portion 68. The opening portion 73 is formed by the recess portion 64, the cylinder base surface 66 and the cylinder skirt extended portion 68, as shown in FIG. 12 corresponding to a view along a line M—M in FIG. 9.

Since the scavenging flow passage 70 of the layered scavenging 2-cycle engine in accordance with the present embodiment is constituted by the first and second scavenging flow passages 71 and 72, the scavenging flow passage becomes larger than the conventional one at the volume of the second scavenging flow passage 72. The amount of pilot air is increased at that amount, so that it is possible to securely achieve the exhaust gas purification. Since the second scavenging flow passage 72 and the opening portion 73 are formed by the recess portion 64 provided on the upper surface 58 of the crank case 5, the cylinder base surface 66, the cylinder skirt portion 67 and the cylinder skirt extended portion 68, the structure is simple, and it is possible to reduce the thickness of the side wall of the crank case 51 in comparison with the case that the scavenging flow passage is provided within the side wall of the conventional crank case 51. Accordingly, it is possible to make the structure compact and light, and the cost can be reduced.

What is claimed is:

1. A piston valve type layered scavenging 2-cycle engine (1) comprising:

a cylinder (10) and a piston (30) to freely slide in an axial direction of the cylinder;

a scavenging port (12), an exhaust gas port (13) and a pilot air port (14) which are open to an inner wall of the cylinder which is attached to an upper portion of a crank case (2), and which communicate with a cylinder chamber (11);

an intake port (15) for an air-fuel mixture which is open to the inner wall of the cylinder, and is which communicates with a crank chamber (3);

a scavenging flow passage (16) which connects the scavenging port and the crank chamber; and a position groove (34) which is provided in an outer peripheral portion of the piston and which connects the scavenging port and the pilot air port at a time of an intake stroke, wherein the scavenging port, the exhaust port, the pilot air port and the intake port are opened and closed by an upward and downward motion of the piston, a lower edge (14*b*) of said pilot air port is arranged at a position toward the crank chamber side displaced from an upper edge (15*a*) of said intake port, said piston includes an extended portion (32) extending beyond a piston lower edge (31) at a position opposing to the intake port of the cylinder, said extended portion being at a position opposing to the pilot air port of said cylinder, and the extended portion is positioned at an outer side of said piston in a direction of a crank shaft (20), and has said piston groove (34) on an outer peripheral surface thereof.

2. A piston valve type layered scavenging 2-cycle engine as claimed in claim 1, wherein the upper edge (15*a*) of said intake port and the upper edge (14*a*) of said pilot air port are positioned at substantially the same height.

3. A piston valve type layered scavenging 2-cycle engine comprising:

a scavenging port (61) which is open to a cylinder chamber (56) of a cylinder (52) mounted on an upper surface of a crank case (51) forming a crank chamber (57) in an inner side thereof, and sucking a pilot air taken from an external portion so as to scavenge; and a scavenging flow passage (70) which is provided in an outer side of the cylinder chamber (56), and communicates the scavenging port and the crank chamber, wherein said scavenging flow passage (70) is constituted by a first scavenging passage (71) which is provided in an outer side of a side wall surface of said cylinder so as to be substantially in parallel to an axis of the cylinder, and a second scavenging flow passage (72) which is provided on an upper surface (58) of said crank case opposing to the first scavenging passage so as to be expanded in a substantially perpendicular direction to the first scavenging passage and has an opening portion (73) communicated with said crank chamber in a terminal portion, and wherein the opening portion and the second scavenging flow passage are formed by:

a recess portion (64) which is provided on the upper surface of said crank case, a cylinder base surface (66) of said cylinder which is brought into contact with the upper surface of the crank case, a cylinder skirt portion (67) in a lower portion of a side surface of the cylinder, and a cylinder skirt extended portion (68) which is extended so as to make a portion opposing to the second scavenging passage in the cylinder skirt portion close to or in contact with a bottom surface portion (65) of the recess portion.

4. A piston valve type layered scavenging 2-cycle engine as claimed in claim 1, wherein said scavenging flow passage (70) is constituted by a first scavenging passage (71) which is provided in an outer side of a side wall surface of said cylinder so as to he substantially in parallel to an axis of the cylinder, and a second scavenging flow passage (72) which is provided on an upper surface of said crank case opposing to the first scavenging passage so as to be expanded in a substantially perpendicular direction to the first scavenging passage, said second scavenging flow passage having an opening portion (73) communicated with said crank chamber in a terminal portion, and the opening portion and the second scavenging passage are formed by:

recess portion (64) which is provided on an upper surface of said crank case, a cylinder base surface (66) of said cylinder which is brought into contact with the upper surface of the crank case, a cylinder skirt portion (67) in a lower portion of a side surface of the cylinder, and a cylinder skirt extended portion (68) which is extended so as to make a portion opposing to the second scavenging passage in the cylinder skirt portion close to or in contact with a bottom surface portion (65) of the recess portion.

* * * * *